US005361430A

United States Patent [19]

Wise

[11] Patent Number: 5,361,430

[45] Date of Patent: Nov. 8, 1994

[54] BABY BATH TUB

[75] Inventor: Robert D. Wise, Akron, Ohio

[73] Assignee: Century Products Company, Macedonia, Ohio

[21] Appl. No.: 130,559

[22] Filed: Oct. 1, 1993

[51] Int. Cl.[5] ..... A47K 3/024

[52] U.S. Cl. ..... 4/572.1; 4/573.1

[58] Field of Search ..... 4/572.1, 573.1, 574.1, 4/575.1, 578.1, 579, 586, 587, 659, 547; 5/122

[56] References Cited

U.S. PATENT DOCUMENTS

| | | | |
|---|---|---|---|
| 392,112 | 10/1888 | Farwell | 5/122 X |
| 1,077,229 | 10/1913 | Palmer | 5/122 |
| 1,271,384 | 7/1918 | Stroll | 4/579 |
| 2,089,801 | 8/1937 | Kennedy | 4/572.1 |
| 2,358,003 | 9/1944 | DePuy | 4/572.1 |
| 3,595,224 | 7/1971 | Walter | 4/573.1 X |

FOREIGN PATENT DOCUMENTS

| | | | |
|---|---|---|---|
| 0019057 | 3/1899 | Switzerland | 4/572.1 |
| 0561534 | 5/1975 | Switzerland | 4/572.1 |
| 0021278 | of 1894 | United Kingdom | 4/572.1 |

*Primary Examiner*—Robert M. Fetsuga
*Attorney, Agent, or Firm*—Graham & James

[57] ABSTRACT

A baby bath tub assembly includes a unitary molded tub having an elongated configuration, and a hammock-like sling suspended longitudinally in the tub to support the baby in the bath water contained in the tub. The sling is formed of an open mesh material that dries rapidly and is machine-washable. A headrest comprising a molded foam cushion and an outer fabric cover is removably fastened to the sling to support the baby's head above water level, while the body is supported by the sling and immersed in the water. The foot end of the tub is provided with a drain opening and plug to facilitate removal of bath water after bathing. The tub also include an integrally formed flange extending continuously thereabout. The sling is supported by a pair of tubular rods secured in hemmed sleeves extending along opposed ends of the sling. The tub includes a pair of laterally opposed, integrally formed slots to releasably secure the rod at the foot of the sling within the tub At the head end of the sling the rod is removably secured under the flange in molded brackets, so that the head end of the sling is higher than the foot end to raise the baby's head. The sling may be provided with gussets, hems and other gathering to shape the sling in accordance with the shape and size of a baby, so that the sling cradles and supports the baby safely and comfortably.

5 Claims, 4 Drawing Sheets

BABY BATH TUB

BACKGROUND OF THE INVENTION

This invention generally relates to baby bath appliances and more particularly to a baby bath tub assembly which holds a baby securely and safely for bathing purposes.

Conventional baby bathtubs generally comprise a large basin for containing water and having an elongated shape dimensioned to receive an infant. A common concern for parents and caretakers bathing a baby is that the experience be enjoyable and safe for the child. One must use one hand to wash and rinse the baby, leaving only one hand to control the baby's body position and to keep the baby's head above the surface of the water. A baby covered with soap and water is extremely slippery, and there is ample opportunity for the baby to wriggle and slip out of control. There is always the potential for accidental submersion of the baby's head and face, which can result in discomfort to the baby, and perhaps serious injury. Thus baby bath time can be full of anxiety and tension, negating the intrinsic joy and pleasure a baby can experience in the warmth and comfort of a well-arranged bath.

Various baby bath appliances are known in the art for supporting the baby during the bath. For example, a large contoured sponge can be placed in the bathtub to position the baby's body and keep the head above water. However, a large sponge absorbs a great amount of water, and thus requires a long drying time. Indeed, the sponge may not dry completely between daily baths, resulting in the possibility of disease vectors, mold, and mildew carried by the sponge.

Another bath appliance for a similar purpose involves an adjustable platform submerged under the water to support the baby's body and head. This arrangement requires an elaborate mechanism to permit height adjustment for babies of differing sizes and growth stages, raising the cost to an unattractive level. The mechanism must be maintained and cleaned regularly, further burdening the parents and caretakers with needless chores.

A further baby tub design includes an integrally formed back rest at one end that raises the baby's upper body above the water level. Although this design increases the safety aspect of the baby bath, comfort may be decreased and bathing of the head and upper body may be more difficult.

Other bath tub arrangements for babies either fail to address the concerns for safety and comfort noted above, or do not successfully remedy the problems known in the prior art.

SUMMARY OF THE INVENTION

The invention generally comprises a baby bath tub assembly that facilitates immersion, bathing, and rinsing of a baby while supporting the baby and maintaining the baby's face and head above water. The baby bath tub assembly includes a unitary molded tub having an elongated configuration. A significant aspect of the invention is the provision of a hammock-like sling suspended longitudinally in the tub to support the baby in the bath water contained in the tub. The sling is formed of an open mesh material that dries rapidly and is machine-washable. A headrest comprising a molded foam cushion and an outer fabric cover is removably fastened to the sling by hook and loop fasteners or the like to support the baby's head above water level, while the body is supported by the sling and immersed in the water.

The sling is supported by a pair of tubular rods secured in hemmed sleeves extending along opposed ends of the sling. The tub includes a pair of integrally formed slots to releasably secure one of the rods at the foot of the sling. The rod at the head end of the sling is removably secured externally to the tub, so that the head end of the sling is higher than the foot end to raise the baby's head above water level. The sling may be provided with gussets, hems and other gathering to shape the sling in accordance with the shape and size of a baby, so that the sling cradles and supports the baby safely and comfortably.

The tub of the invention further includes a generally planar bottom portion for stable support in a sink or bathtub, or on a countertop. The foot end of the tub is provided with a drain opening and plug to facilitate removal of bath water after bathing. The tub also include an integrally formed flange extending continuously thereabout to strengthen the continuous sidewall and to facilitate manual gripping of the tub. The sling support rod at the head end is secured under the flange in molded brackets. The sling is completely detachable from the tub by removing the support rods from their engagement in the tub brackets and sliding the rods out of their respective hemmed sleeves. The headrest is removable by releasing the hook and loop fasteners holding the headrest to the sling. The sling and headrest may then be dried very quickly, due to the use of lightweight mesh material, and may also be laundered by machine or by hand.

DESCRIPTION OF THE PREFERRED EMBODIMENT

Figure 1:
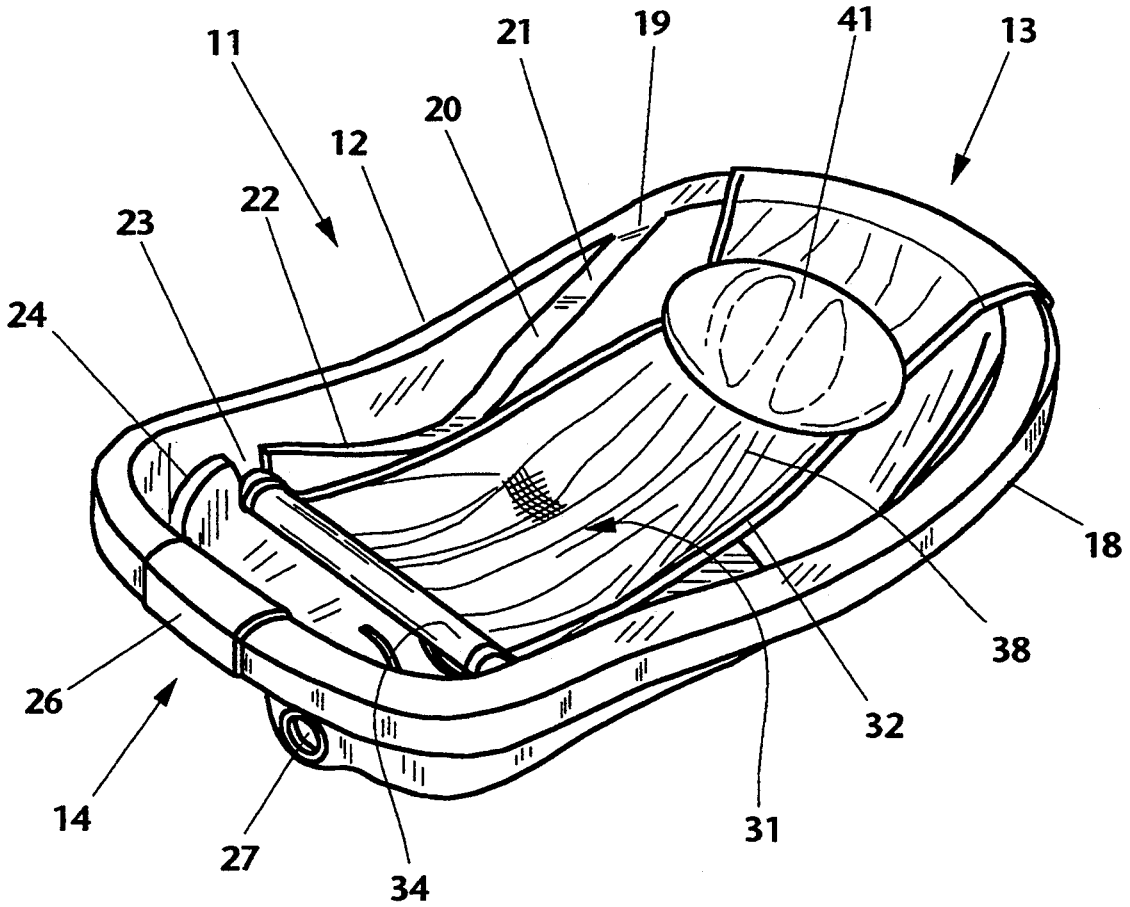
FIG. 1 is a perspective view of the baby bath tub assembly of the invention, viewed obliquely from the foot of the assembly.
Figure 6:
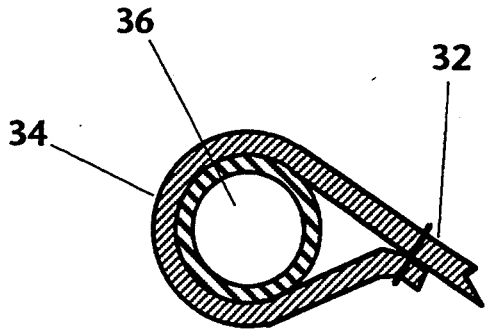
FIG. 6 is an enlarged cross-sectional view of a sling pocket and sling support rod assembly.
Figure 2:
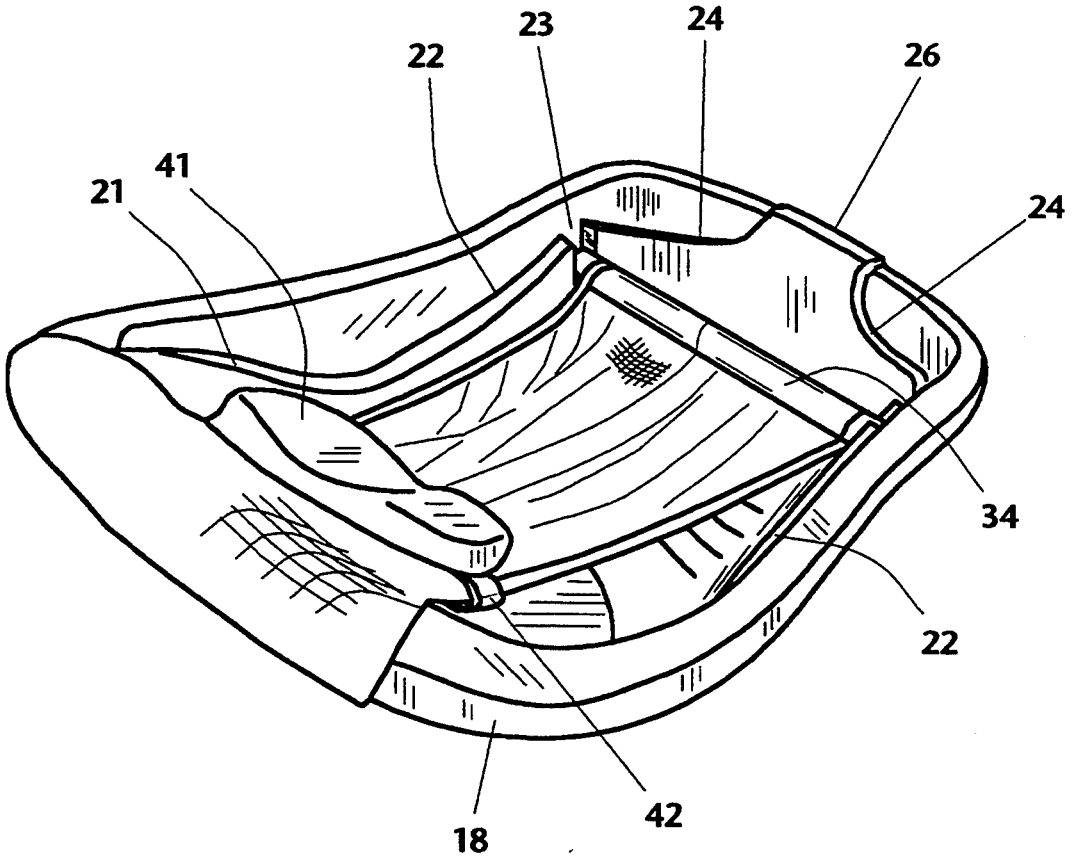
FIG. 2 is a perspective view of the baby bath tub assembly of the invention, viewed obliquely from the head of the assembly.

The invention generally comprises a bath tub assembly for bathing a baby or infant safely and comfortably. With regard to FIGS. 1–3, the baby bath tub assembly 11 includes a tub 12 having a head end 13 and a foot end 14. The tub is configured with a complex oblong curved shape, as described below, and preferably may be molded of resilient polymer in unitary fashion. The tub includes a continuous sidewall 16 extending upwardly from a bottom wall 17 that is configured generally flat to be ground-engaging in stable fashion. The sidewall 16 is higher at the head end 13 than the foot end 14. A drop-edge flange 18 extends integrally and continuously from the upper edge of the sidewall to add strength and grip access to the sidewall.

Integrally molded in the sidewall 16 are a pair of longitudinally extending ledges 20. Each ledge 20 includes one end portion 19 smoothly blended into the flange 18 adjacent to the head end 13, and a descending portion 21 leading to an ascending portion 22. A slot 23 is integrally formed in the ascending portion 22, which continues as a curved ledge 24 that blends into a respective side of an integral handle 26 formed in the foot end of the flange 18. The ledges 20 serve both to reinforce the sidewall extending from head end to foot end, and to define the pair of opposed slots 23.

The tub 12 further includes a drain opening 27 formed in the sidewall 16 adjacent to the bottom wall 17 and positioned at the foot end of the tub. The drain opening 27 is provided with a resilient plug or stopper (not shown) to facilitate filling the tub with water and emptying the tub as required.

Figure 3:
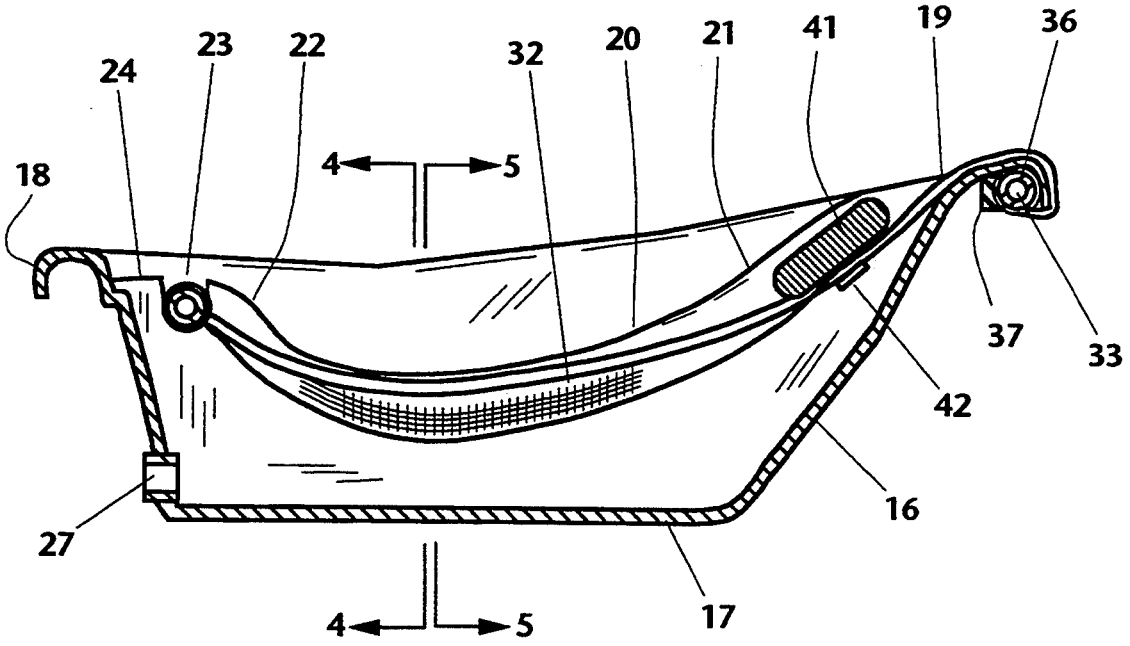
FIG. 3 is a longitudinal cross-sectional elevation of the baby bath tub assembly shown in FIGS. 1 and 2.
Figure 4:
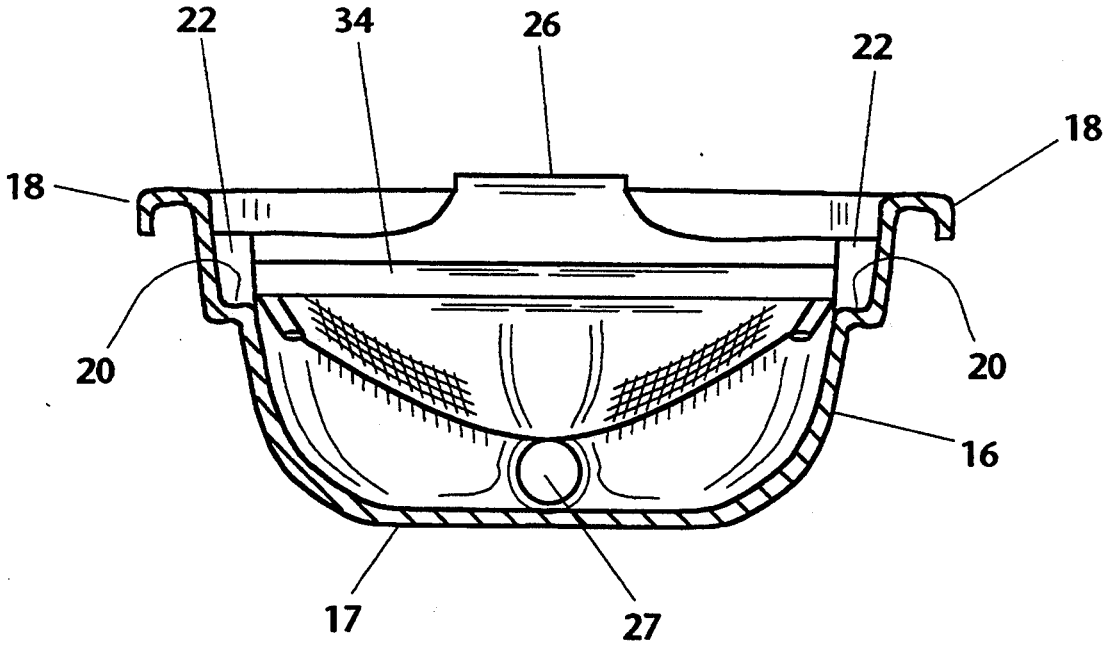
FIG. 4 is a lateral cross-sectional elevation of the baby bath tub assembly, taken along line 4—4 of FIG. 3.
Figure 5:
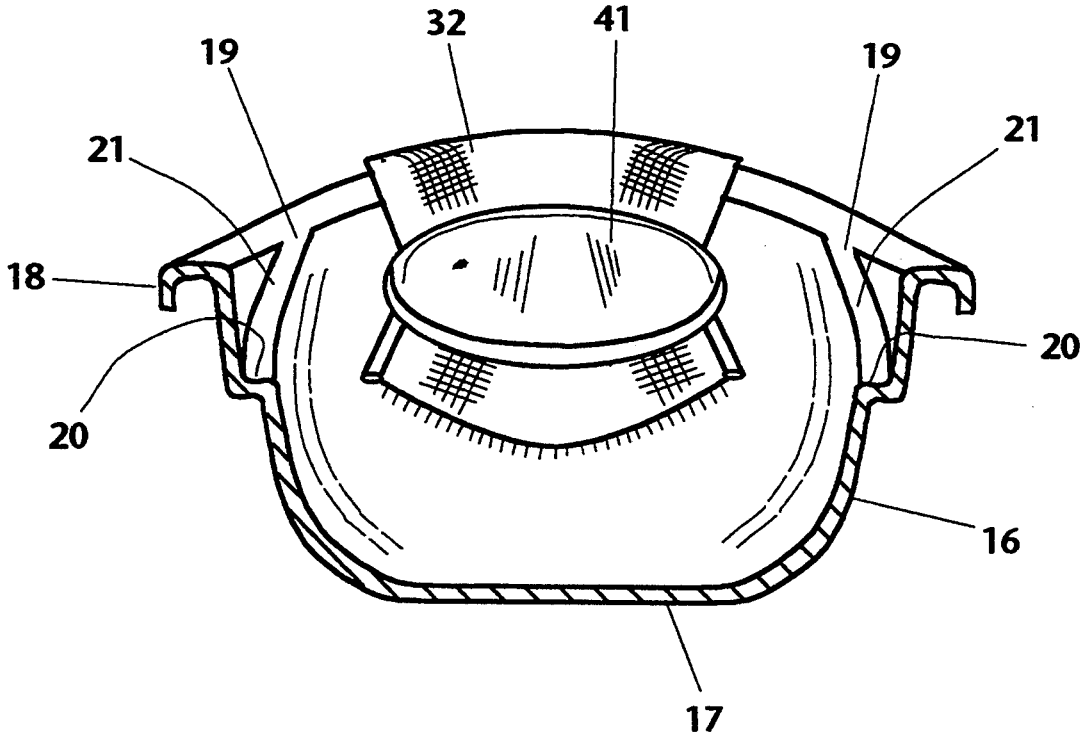
FIG. 5 is a lateral cross-sectional elevation of the baby bath tub assembly, taken along line 5—5 of FIG. 3.

A salient feature of the assembly 11 is a sling assembly 31 for suspending a baby within the bath water contained in the tub. The sling assembly includes a fine mesh sling 32 suspended longitudinally in the tub, with hemmed sleeves 33 and 34 formed at the head and foot ends, respectively, of the sling. A pair of support rods 36 are removably secured within the sleeves 33 and 34, and are disposed to extend laterally with respect to the tub. The support rod 36 disposed in the sleeve 34 is dimensioned to be engaged in the opposed slots 23 in the sidewall 16 of the tub, so that the foot of the sling is suspended within the tub adjacent to the foot end of the tub. The other rod 36 in the sleeve 33 is secured within the head end portion of the drop-edge flange 18, as shown in FIG. 3, by a bracket 37 secured thereat. The head end of the sling is thus extended over the flange 18 to descend into the upward opening of the tub, whereby a great proportion of the tension applied to the head end of the sling is supported by the flange 18. Both rods 36 are selectively disengageable from the tub 12 and removable from their respective sleeves, so that the sling 32 may be removed, dried, or laundered with ease.

The head end portion of the sling is provided a plurality of gussets or gathers 38 which join laterally adjacent portions of the fine mesh material to reduce the lateral extent of the sling at the head end. Gusseting or gathering may be achieved by longitudinally extending seams formed in the mesh material, or by weaving the sling in such fashion. The gussets 38 reduce the lateral extent of the sling at the medial-head portion to cradle the shoulders of a baby supported in the sling assembly. The foot end retains more fullness to contain the lower body and legs of the baby, and permits those portions of the baby to depend deeper into the bath water within the tub.

The sling assembly further includes a head rest 41, comprising an oval pillow formed of soft foam and covered by a washable fabric. A strap 42 is secured to the head rest 41, and circumscribes the sling 32 adjacent to the head end. The strap 42 is adjustable in length by a hook and loop closure, and may constrict the lateral width of the sling at the head end. The strap 42 permits the head rest 41 to be adjustably positioned in height to accommodate babies of differing sizes and growth stages. The strap 42 is an adjunct to the gussets and gathers 38 in reducing the effective width of the head end of the sling and enhancing its cradling effect on the upper body of the baby.

It may be appreciated that the fine mesh sling supports a baby in suspended fashion immersed within the bath water contained in the tub, and that the mesh allows free circulation of the bath water about the baby. The sling permits the parent or caretaker to use both hands to wash the baby, as the sling obviates the need to dedicate one hand to constantly stabilize the position of the baby in the water. The head rest also assure that the baby's face will remain above the water level. Thus the sling provides comfort, safety, confidence, and increased freedom for the individual conducting the bath.

The fine mesh material of the sling absorbs little water, and dries very quickly. The head rest may be fabricated from closed cell foam material that also absorbs very little water and dries quickly. All materials may be laundered by machine to maintain cleanliness.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. A baby bath tub, comprising:

a tub having a head end and a foot end, and a top and bottom, with a curvilinear overhanging edge surrounding the periphery of said tub and defining said top, and an interior portion for holding water, said tub having formed therein a a pair of slots at said foot end, and curvilinear sidewalls;

a sling made of a mesh fabric suspended between said two ends, said mesh fabric having two ends each doubled over and joined together to form a loop of fabric at both said two fabric ends, and support rods fitted inside said fabric loops, one of said support rods received by said slots, and the other of said support rods received underneath a portion of said curvilinear overhanging edge at said head end of said tub;

a pair of ledges each extending below said top of said tub, in said interior portion of said tub, and integral with said tub sidewalls, spanning said tub sidewalls, said slots being formed in said ledge;

a headrest connected to said mesh sling at said head end;

wherein said mesh fabric sling may be removably detached from said tub and from said support rods, to allow said fabric sling to be laundered.

2. The baby bath of claim 1, further comprising a bracket spaced to fit in said underneath portion of said overhanging edge to secure said other support rod, and a drain opening at said tub bottom.

3. The baby bath tub of claim 2, wherein said headrest is a made of a closed cell foam material and is removably attached to said fabric sling.

4. The baby bath tub of claim 3, further comprising an adjustable strap to constrict the lateral width of said fabric sling at said head end.

5. The baby bath tub of claim 4, wherein said tub forms at said periphery an oblong curved shape and is molded of a resilient polymer material in a one-piece unitary fashion.

* * * * *